United States Patent [19]

Hitzman

[11] Patent Number: 4,724,570

[45] Date of Patent: Feb. 16, 1988

[54] TOOTHBRUSH FOR SULCULAR BRUSHING

[76] Inventor: Alice F. Hitzman, 924 S. Ridgecrest Cir., Anaheim, Calif. 92807

[21] Appl. No.: 887,601

[22] Filed: Jul. 17, 1986

[51] Int. Cl.[4] ..... A46B 9/04

[52] U.S. Cl. ..... 15/167.1; 15/110; 15/143 R; D4/104

[58] Field of Search ..... 15/167 R, 110, 143 R, 15/DIG. 5; D4/104–112

[56] References Cited

U.S. PATENT DOCUMENTS

| | | | |
|---|---|---|---|
| D. 110,185 | 6/1938 | Lukenbill | D4/104 |
| D. 243,422 | 2/1977 | Varga | D4/104 |
| 1,018,927 | 2/1912 | Sarrazin | 15/167 R |
| 2,304,319 | 12/1942 | Saltzman | 15/167 R |
| 2,378,641 | 6/1945 | Kisky | 15/167 R |
| 4,033,008 | 7/1977 | Warren et al. | 15/167 R |
| 4,519,109 | 5/1985 | Raymond | 15/167 R |
| 4,542,552 | 9/1985 | d'Argembeau | 15/167 R |

*Primary Examiner*—Peter Feldman

*Attorney, Agent, or Firm*—W. Edward Johansen

[57] ABSTRACT

The present invention is an improved toothbrush for sulcular brushing which includes a head, a shank and a handle. The head has a rounded heel, a rounded toe which is narrower than the rounded heal in order to facilitate reaching the distal surface of either the last tooth in the arch or an isolated tooth, a pair of rounded sides both of which benignly interface with the soft oral tissue and a flat top surface on which multitufted bristles are disposed. The multitufted bristles include a plurality of rows of tufts spaced to provide two smooth, orthogonal brushing planes intersecting each of the rounded sides and a lingual brushing plane intersecting both of the two smooth, orthogonal brushing planes to form a smooth angled heel for cleaning the sulcus and the gingival third of lingual surface of the anterior teeth of both arches. The center row of the plurality of rows of tufts includes a set of the longest individual bristles each of which has a diameter of 0.006 inch (soft) and each of the rows adjacent to the center rows includes a set of the appropriately shorter individual bristles each of which has a diameter of 0.007 inch (soft). The shank is mechanically coupled to the head and is disposed at such an angle that the head can more readily reach the posterior teeth. The handle has four similarly sized sides which are disposed at an angle of 45° to the flat top surface, the top two of which are concave and the bottom two of which are convex and is rotated about its longitudinal axis.

1 Claim, 7 Drawing Figures

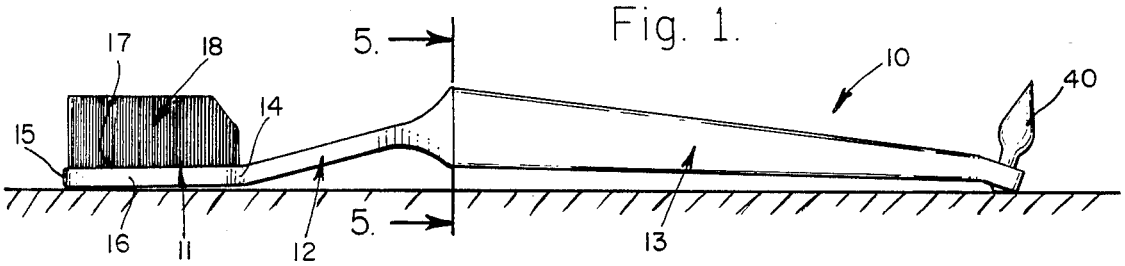
Fig. 1.
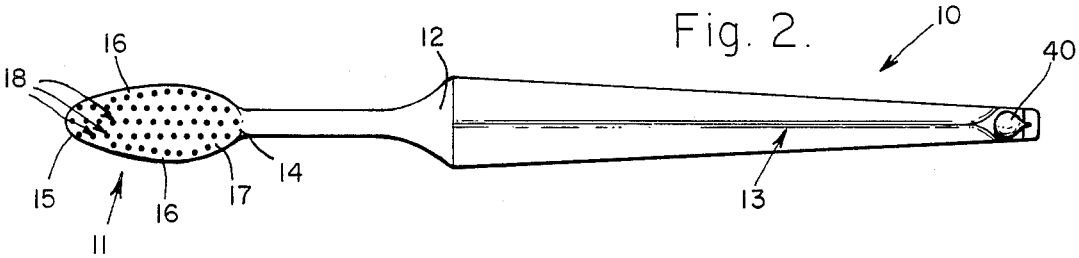
Fig. 2.
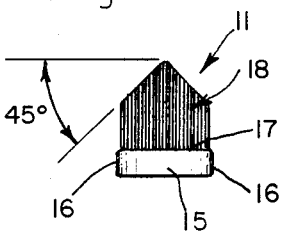
Fig. 3.
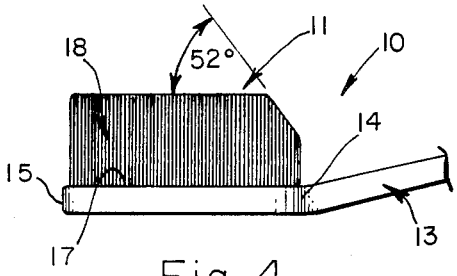
Fig. 4.
Fig. 5.
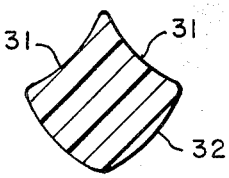
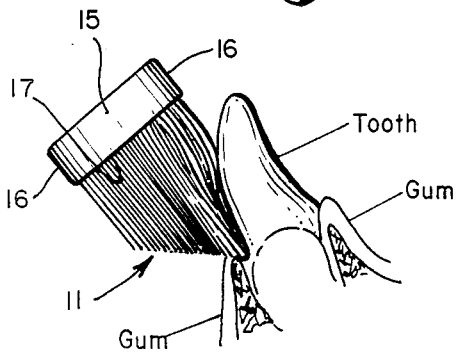
Fig. 7.
Fig. 6.
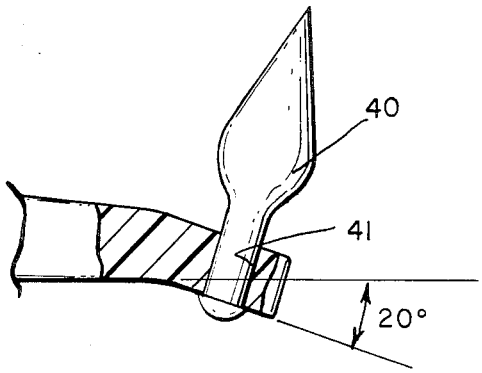

TOOTHBRUSH FOR SULCULAR BRUSHING

BACKGROUND OF THE INVENTION

1. Field of the Invention

The present invention relates to a toothbrush for sulcular brushing and more particularly to a toothbrush which aids in the proper placement of the bristles by considering both the soft tissue anatomy and the dental and arch morphology in order to remove dental plaque adjacent to and directly beneath the gingival margin, open interproximal areas and exposed root surfaces.

2. Description of the Prior Art

U.S. Pat. No. 4,519,109, entitled Tooth Brush, issued to Beach D. Raymond on May 28, 1985, teaches a toothbrush which keeps the decayed teeth and gingival portion of a user in a hygienic and healthy condition. The toothbrush includes a grip portion of a shank which is to be held between the user's thumb and first finger with respect to his lower jaw and upper jaw. The shank is formed intermediate thereof in an opposedly inclined shape so as to enable him to cleanly brush his tooth especially cased with gold and also whole gingival surface area by a finger massage operation. The toothbrush is also constructed so the grip portion of the shank is provided rearwardly with projection for pressing against the gingival portion thereby enabling the user to preceive the seat of gingivitis at an earlier stage by feeling pain when the projection is applied to this gingival portion.

U.S. Pat. No. 4,542,552, entitled Toothbrushes, issued to Etienne Y. dArgembeau on Sept. 24, 1985, teaches a toothbrush the head of which has a circular or elliptical cross-section and carries at least one tuft of bristles. The width of the tuft of bristles substantially corresponds to the depth of the sulcular sulcus. The head of the toothbrush is joined to a handle which has a polygonal cross-section, preferably a square cross-section. The median longitudinal plane of the tuft of bristles advantageously forms an angle of less than 90°, preferably an angle of 45°, with the plane of at least one surface of the handle having a polygonal cross-section, which surface is turned towards the free end of the tuft of bristles.

U.S. Pat. No. 4,438,541, entitled Toothbrush with Heat Shrunk Synthetic Filaments, issued to Joseph Jacob and Charles J. Love on Mar. 27, 1984, teaches a new method of dental plaque removal along with a structure of each bristle which enables the method to be used most efficiently. A filiment loop of contractible material such as polyprolylene is caused to shrink as it being attached to a base. The loop exhibits an extraordinary contraction wherein the loop is not merely reduced as expected, but by the same process it contracts into tightly adjacent filaments with a tight return loop. The resulting bristle not only solves the vexing problem of proper bristle polishing, but as an unexpected additional value, exhibits a greatly improved capability to actually scoop away tooth deposits such as plaque.

U.S. Pat. No. 4,517,701, entitled Toothbrush for Cleaning Sulcular Areas of the Teeth, issued to Roy E. Standford, Jr. on May 21, 1985, teaches a toothbrush which is specifically for cleaning the sulcular areas of the teeth below the gumline.

U.S. Pat. No. 4,519,111, entitled Toothbrush Having Series of Bristles of Different Height, issued to Paolo Cavazza on May 28, 1985, teaches a toothbrush which has its bristles grouped into tufts which are arranged in parallel rows of different heights.

Presently there is no one toothbrush which combines the features necessary for facilitating the sulcular method of brushing which removes plaque from the gingival sulcus and along the margin and the lower one third of the teeth. The removal of plaque from these areas is vital in controlling gingivitis and is indicated for those patients requiring periodontal rooting planing and curattage procedures and/or periodontal surgery. Due to potential recession of the gum tissue only a soft nylon brush with rounded filament bristles is advised. There are many toothbrushes with soft filament bristles along with other features recommended for the use of the sulcular method of brushing. However, many of these fail to consider both the soft tissue sulcular anatomy and the dental and arch morphology. Furthermore, the designs of their handles do not consider patient dexterity. One of the difficulties of the sulcular method of brushing is the proper placement of bristles to the gumline especially for those patients who have been using the roll or vertical method of brushing. The sulcular method of brushing requires that the filiments be placed at an angle of approximately 45° with the long axis of the tooth so that bristle tips are directed straight into the gingival sulcus. It is recommended that the patient first place the toothbrush at an angle of 90° and then make the final adjustment. The improved toothbrush has a handle which is not flat trim, but which incorporates 45° concave angles so when the thumb and index finger grip the handle the bristles will be directed automatically into the gingival sulcus.

It would further be useful to design a toothbrush head which instead of being rectangular in shape is narrower at both heel and toe, being slightly more so at the toe. The narrow toe will allow for easy cleaning of the distal surface of the last tooth in the arch or for isolated teeth. The narrow heal will fit the lingual of the anterior teeth in both arches. This will be especially helpful for those with crowding and aid in ease of cleaning this area. This is a difficult area due to the anatomy of the arch and the tendency for excessive calculus build up.

The stiffness of a toothbrush is determined by the diameter of the nylon filament. The improved toothbrush contains only the softest bristles of the narrowest diameter. The center row will be 0.006 inch in diameter. The center row is the concentrated area for sulcus plaque removal and thus must be the softest possible. The remaining outer rows of bristles will be 0.007 inch in diameter, which is stil considered soft, but slightly larger, in order to aid in curability and longevity of a toothbrush. Using a stiffer toothbrush can lead to gum recession and tooth abrasion which are both irreversible problems.

Many toothbrushes on the market are supplied with a rubber tip stimulator. This ia a conical or tear-shaped flexable rubber tip. It can reshape tissue, increase firmness and stimulate circulation. A patient in need of a rubber tip stimulator should receive specific instructions because inasmuch as most patients do not know what the rubber tip stimulator is for and many times have been using it incorrectly and for the wrong reasons. The improved toothbrush will provide an area for the addition of a rubber tip stimulator to be recommended as seen indicated.

SUMMARY OF THE INVENTION

In view of the foregoing factors and conditions which are characteristic of the prior art it is the primary object of the present invention to provide for a toothbrush for sulcular method of brushing which aids in the proper placement of the bristles by considering both the soft tissue anatomy and the dental and arch morphology in order to remove dental plaque adjacent to and directly beneath the gingival margin, open interproximal areas and exposed root surfaces.

In accordance with the preferred embodiment of the present invention an improved toothbrush for the sulcular method brushing is described. The improved toothbrush includes a head, a shank and a handle. The head has a rounded heel, a rounded toe which is narrower than the rounded heal in order to facilitate reaching the distal surface of either the last tooth in the arch or an isolated tooth, a pair of rounded sides both of which benignly interface with the soft oral tissue and a flat top surface on which multitufted bristles are disposed. The multitufted bristles include a plurality of rows of tufts spaced to provide two smooth, orthogonal brushing planes intersecting each of the rounded sides and a lingual brushing plane intersecting both of the two smooth, orthogonal brushing planes to form a smooth angled heel for cleaning the sulcus and the gingival third of lingual surface of the anterior teeth of both arches. The center row of the plurality of rows of tufts includes a set of the longest individual bristles each of which has a diameter of 0.006 inch (soft) and each of the rows adjacent to the center rows includes a set of the appropriately shorter individual bristles each of which has a diameter of 0.007 inch (soft). The shank is mechanically coupled to the head and is disposed at such an angle that the head can more readily reach the posterior teeth. The handle has four similarly sized sides which are disposed at an angle of 45° to the flat top surface, the top two of which are concave and the bottom two of which are convex and is rotated about its longitudinal axis.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a side elevation of an improved toothbrush for sulcular method of brushing which aids in the proper placement of the bristles and considers both the soft tissue anatomy and the dental and arch morphology and which has been constructed in accordance with the principles of the preferred embodiment of the present invention.

FIG. 2 is a top plan view of the improved toothbrush of FIG. 1.

FIG. 3 is a front elevation of the improved toothbrush of FIG. 1.

FIG. 4 is an enlarged front portion of the side elevation of the improved toothbrush of FIG. 1.

FIG. 5 is a transverse view in cross-section of the improved toothbrush of FIG. 1 taken along line 5—5 of FIG. 1.

FIG. 6 is an enlarged rear portion of the side elevation in cross-section of the improved toothbrush of FIG. 1.

FIG. 7 is a schematic drawing of a tooth which is being brushed by the improved toothbrush of FIG. 1.

DESCRIPTION OF THE PREFERRED EMBODIMENT

In order to best understood the present invention it is necessary to refer to the following description of its preferred embodiment in conjunction with the accompanying drawing. Referring to FIG. 1 in conjunction with FIG. 2 an improved toothbrush 10 for sulcular brushing which includes a head 11, a shank 12 and a handle 13 which is mechanically coupled to the shank 12. The head 11 has a rounded heel 14, a rounded toe 15 which is narrower than the rounded heal 14 in order to facilitate reaching the distal surface of either the last tooth in the arch or an isolated tooth, a pair of rounded sides 16 both of which benignly interface with the soft oral tissue and a flat top surface 17 on which multitufted bristles 18 are disposed. The multitufted bristles 18 include a plurality of rows of tufts spaced to provide two smooth, orthogonal brushing planes intersecting each of the rounded sides and a lingual brushing plane intersecting both of the two smooth, orthogonal brushing planes to form a smooth angled heel for cleaning the sulcus and the gingival third of lingual surface of the anterior teeth of both arches. The center row of the plurality of rows of tufts includes a set of the longest individual bristles each of which has a diameter of 0.006 inch (soft) and each of the rows adjacent to the center rows includes a set of the appropriately shorter individual bristles each of which has a diameter of 0.007 inch (soft). The shank 12 is mechanically coupled to the head and is disposed at such an angle that the head 11 can more readily reach the posterior teeth. The multitufted bristles 18 of the improved toothbrush 10 are arranged with the groups of bristles (tufts) arranged interspersed thereby providing a smooth continuous working surface and allowing the bristle to support each other for longer durability. Each tuft will contain approximately forty bristles.

Referring to FIG. 3 and FIG. 4 in conjunction with FIG. 1 and FIG. 2 the two very important features of the improved toothbrush 10 include a symmetric array of the multitufted bristles 18 at an angle of 45° following the long axis of the head 11 and a placement of the heel 14 at an angle of approximately 52° to one of the brushing planes.

Referring to FIG. 5 in conjunction with FIG. 1 and FIG. 2 and handle 13 has four similarly sized sides 31 and 32 which are disposed at an angle of 45° to the flat top surface 17, the top two 31 of which are concave and the bottom two 32 of which are convex and is rotated about its longitudinal axis.

Referring to FIG. 6 in conjunction with FIG. 1 and FIG. 2 the improved toothbrush 10 provides an area for the addition of a rubber tip stimulator 40 which may either be attached by screw in or by pressure fit into a hole 41 in the handle 13. The rubber tip stimulator 40 is to be supplied separately for dental offices and the general public in order to insure that it will be used only in the correct instances.

Referring to FIG. 7 the angled bristles offer a concentrated working area, when the improved toothbrush 10 is placed at the proper angle the center row will be placed subginival allowing for removal of harmful sulcular plaque. At the same time the shorter outer bristles will not traumatize the tissue apical to the gumline, but will remove plaque from the lower one-third of the teeth. Again these areas are the most prevalent for plaque formation and the areas concerned about in controlling gingivitis. When a flat trim brush is used at the outer bristles interfere and need to be splayed to allow the center bristles into the sulcus. Some clinicians recommend that the outer row of bristles be used for a better adaptation into the sulculs. However, this does not clean the lower one-third of the teeth efficiently and if the proper angle is not used many patients will be brushing the attached gingiva which can lead to recession. The angle of approximately 52° at the heel 14 when placed perpendicular to the arch aids in cleaning the anterior lingual teeth of the mazillary and mandibular arch in order to offer a narrow concentrated working area.

Prior to the improved toothbrush 10 there has been no one toothbrush on the market which combines many features necessary for plaque removal below the gumline and which considers patient dexterity. According to standards and practices of the dental profession the mechanical removal of plaque by brushing and flossing is the best way to control gingivitis and arrest periodontal disease. It is the proper placement of the bristles of the improved toothbrush 10 to the gumline which controls gum inflammation and removes bacterial plaque.

From the foregoing it can be seen that an improved toothbrush 10 for sulcular brushing has been described. The improved toothbrush 10 aids in the proper placement of the bristles by considering both the soft tissue anatomy and the dental and arch morphology in order to remove dental plaque adjacent to and directly beneath the gingival margin, open interproximal areas and exposed root surfaces. It should be noted that distances of and between the figures are not to be considered significant.

Accordingly it is intended that the foregoing disclosure and showing made in the drawing shall be considered only as an illustration of the principles of the present invention.

What is claimed is:

1. An improved toothbrush for sulcular brushing which aids in the proper placement of the bristles and considers both the soft tissue and anatomy and the dental and arch morphology, said improved toothbrush comprising:

a. a head moving rounded heel, a round toe which is narrower than said rounded heal in order to facilitate reaching the distal surface of either the last tooth in the arch or isolated teeth, a pair of rounded sides both of which benignly interface with the soft oral tissue and a flat top surface on which multitufted bristles are disposed, said multitufted bristles include a plurality of rows of tufts spaced to provide two smooth, orthogonal brushing planes intersecting each of said rounded sides wherein the center row of said plurality of rows of tufts includes a set of the longest individual bristles each of which has a diameter of 0.006 inch and each of said row adjacent to the center row includes a set of appropriately shorter individual bristles each of which has a diameter of 0.007 inch wherein said multitufted bristles comprise a lingual brushing plane intersecting both of said two smooth, orthogonal, brushing planes to form a smooth angled heel for cleaning the sulcus and the gingival third of lingual surface of the anterior teeth of both arches;

b. a shank is mechanically coupled to said head and is disposed at such an angle that said head can more readily reach the posterior teeth; and c. a handle which has four similarly sized sides the top two of which are concave and the bottom two of which are convex and which is rotated about its longitudinal axis so that all of said four sides are dispose at an angle of 45° to said flat top surface.

* * * * *